US007631532B2

(12) United States Patent
Franco et al.

(10) Patent No.: US 7,631,532 B2
(45) **Date of Patent: *Dec. 15, 2009**

(54) COLD-HEADED STANDOFF

(75) Inventors: James S. Franco, Wind Gap, PA (US); Thomas K. Litzenberger, Ottsville, PA (US)

(73) Assignee: PEM Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/146,859

(22) Filed: Jun. 26, 2008

(65) Prior Publication Data

US 2008/0302162 A1 Dec. 11, 2008

Related U.S. Application Data

(60) Division of application No. 11/464,549, filed on Aug. 15, 2006, now Pat. No. 7,421,875, which is a continuation of application No. 10/479,048, filed as application No. PCT/US03/07832 on Mar. 18, 2003, now abandoned.

(51) Int. Cl.
*B21J 13/00* (2006.01)

(52) U.S. Cl. ..... 72/352; 72/355.2; 72/355.4; 72/370.1; 83/123; 83/686; 470/21; 470/141

(58) Field of Classification Search ..... 72/344, 72/352, 355.2, 370.1; 73/355.4; 470/21, 470/27, 25, 26, 141, 152, 89, 128; 83/50, 83/55, 621, 123, 132, 686

See application file for complete search history.

(56) References Cited

U.S. PATENT DOCUMENTS 604,376 A * 5/1898 Egge ..... 72/330

(Continued)

FOREIGN PATENT DOCUMENTS

JP S50-10565 8/1975

(Continued)

OTHER PUBLICATIONS

Oberg, Erik; Jones, Franklin D.; Horton, Holbrook L.; Ryffel, Henry H. Machinery's Handbook (27th Edition) & Guide to Machinery's Handbook. pp. 2930-2947. Industrial Press.Online version available at: http://knovel.com/web/portal/browse/display?_EXT_KNOVEL_DISPLAY_bookid=1074&VerticalID=0.*

(Continued)

*Primary Examiner*—Kenneth E. Peterson
*Assistant Examiner*—Sean Michalski
(74) *Attorney, Agent, or Firm*—Gregory J. Gore

(57) ABSTRACT

A process for cold forging a metal fastener such as a self-clinching standoff includes a punch and die set at the final head trimming station which produces the shear burr only on the underside of the fastener head where it is not visible after installation. A knock-out pin which is reciprocal within the bore of the punch forcibly ejects the fastener through a passage in the die to a point beyond an opposite side of the die. A stripper sleeve which is reciprocal about the outside surface of the punch then moves from a retracted position over the end of the punch pushing a residual scrap ring from around the outside of the punch.

12 Claims, 3 Drawing Sheets

U.S. PATENT DOCUMENTS

| | | | | | |
|---|---|---|---|---|---|
| 726,800 | A | * | 4/1903 | Langbein | 72/346 |
| 1,428,174 | A | | 9/1922 | Luther | |
| 1,501,081 | A | * | 7/1924 | Wilcox | 470/27 |
| 1,636,691 | A | | 7/1927 | Heames et al. | |
| 1,822,468 | A | | 9/1931 | Wales | |
| 1,855,372 | A | * | 4/1932 | White | 72/467 |
| 2,518,433 | A | * | 8/1950 | Friedman | 83/160 |
| 2,753,986 | A | * | 7/1956 | Morse | 72/344 |
| 3,101,534 | A | * | 8/1963 | Lange | 72/254 |
| 3,186,209 | A | * | 6/1965 | Friedman | 72/334 |
| 3,254,550 | A | * | 6/1966 | McDonald | 83/128 |
| 3,267,500 | A | * | 8/1966 | McClellan | 470/89 |
| 3,296,905 | A | | 1/1967 | Killaly | |
| 3,496,818 | A | * | 2/1970 | Porter et al. | 83/140 |
| 3,540,255 | A | * | 11/1970 | Hanna | 72/256 |
| 3,604,297 | A | | 9/1971 | Gilev et al. | |
| 3,611,850 | A | | 10/1971 | Elliot | |
| 3,620,113 | A | | 11/1971 | Gargrave | |
| 3,640,167 | A | | 2/1972 | Axtmann | |
| 3,968,674 | A | | 7/1976 | Ishida | |
| 4,173,883 | A | * | 11/1979 | Boik | 72/352 |
| 4,291,568 | A | * | 9/1981 | Stifano, Jr. | 72/356 |
| 4,352,283 | A | * | 10/1982 | Bailey | 72/355.2 |
| 4,391,118 | A | | 7/1983 | Martin | |
| 4,391,171 | A | | 7/1983 | Wendt | |
| 4,409,460 | A | * | 10/1983 | Nishii et al. | 219/93 |
| 4,463,637 | A | * | 8/1984 | Delio et al. | 83/40 |
| 4,590,780 | A | * | 5/1986 | Bachmann | 72/328 |
| 4,951,537 | A | * | 8/1990 | Bennett | 83/76.6 |
| 5,373,720 | A | * | 12/1994 | Ratte et al. | 72/354.8 |
| 6,485,371 | B2 | * | 11/2002 | Sakamura et al. | 470/26 |
| 6,669,399 | B2 | | 12/2003 | Janek, Jr. | |
| 6,701,768 | B2 | * | 3/2004 | Ling et al. | 72/356 |
| 6,866,769 | B2 | * | 3/2005 | Anderson et al. | 205/640 |
| 7,175,533 | B2 | * | 2/2007 | Franco et al. | 470/27 |
| 2003/0089621 | A1 | * | 5/2003 | Anderson et al. | 205/660 |
| 2004/0151558 | A1 | * | 8/2004 | Klopper | 411/403 |

FOREIGN PATENT DOCUMENTS

| | | |
|---|---|---|
| JP | H9-057390 | 3/1997 |

OTHER PUBLICATIONS

Higgins, Raymond A. Engineering Metallurgy—Applied Physical Metallurgy (6th Edition). Chapter 6 "Industrial Shaping of Metal". Elsevier. Online version available at: http://knovel.com/web/portal/browse/display?_ EXT_KNOVEL_DISPLAY_bookid=1356 &VerticalID=0.*

* cited by examiner

FIG.1
Prior Art
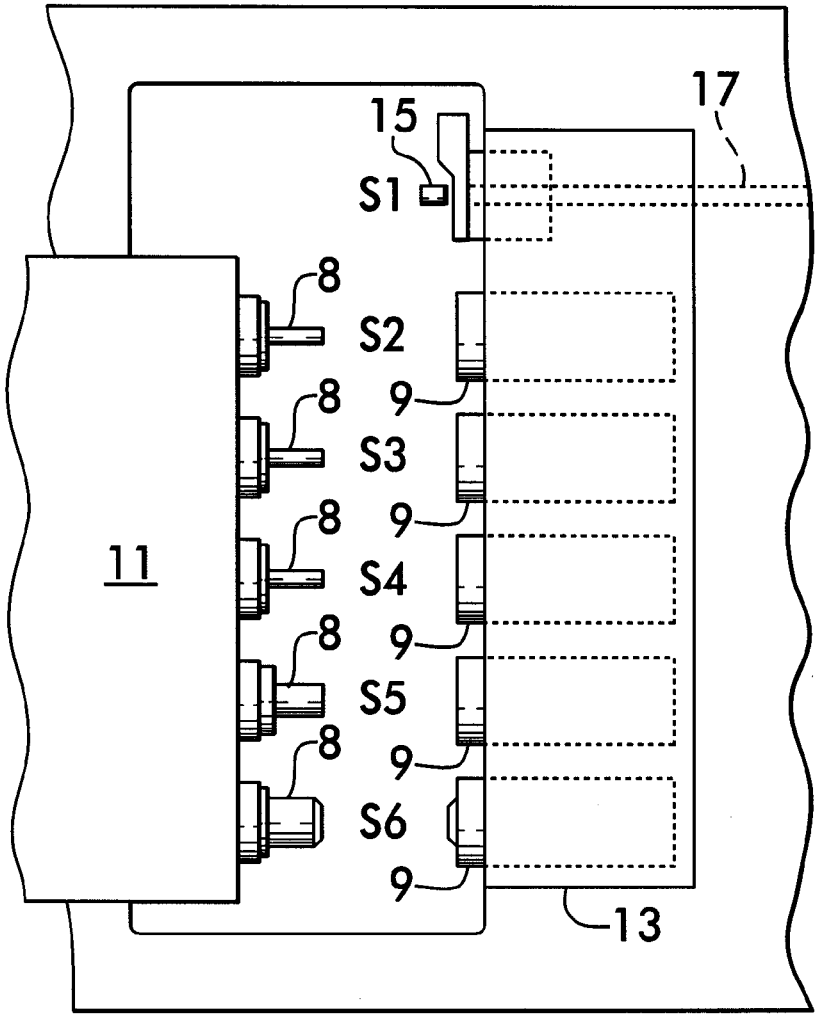
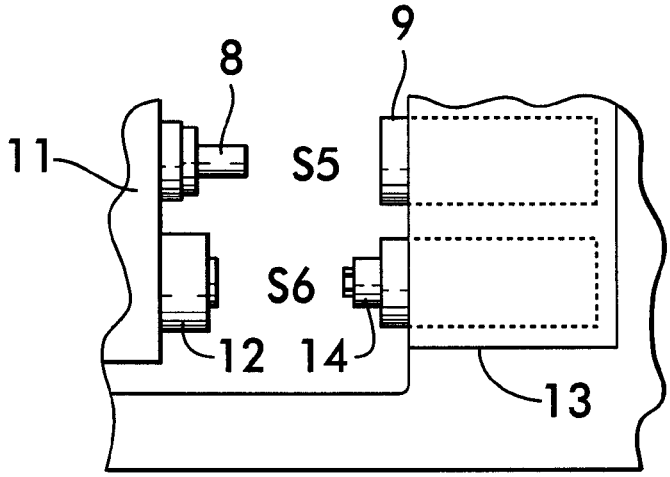
FIG.2

FIG. 6A
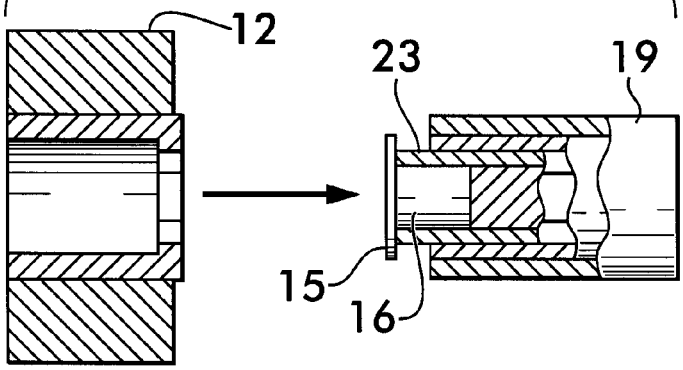
FIG. 6B
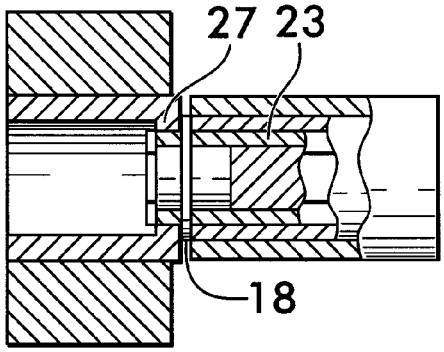
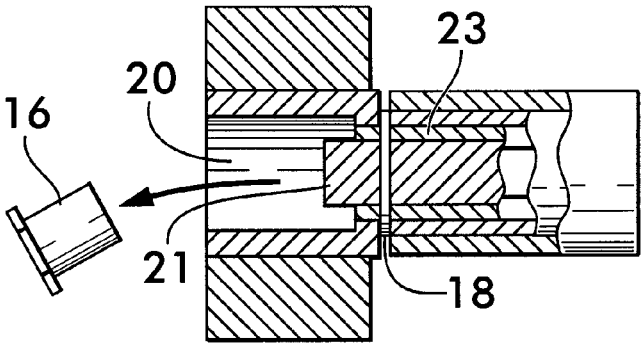
FIG. 6C
FIG. 6D
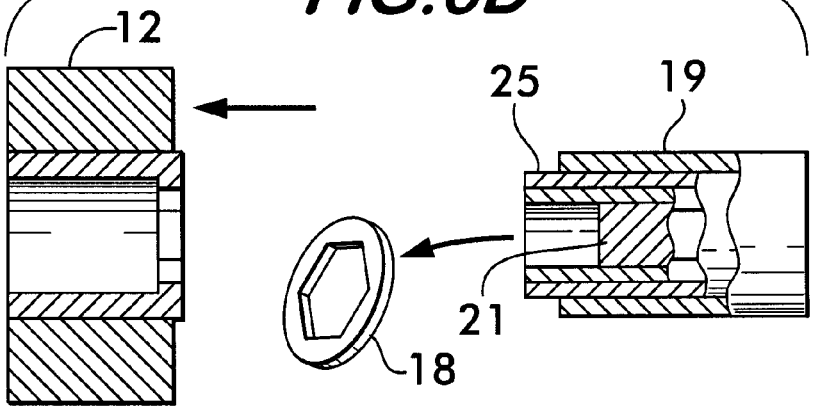

COLD-HEADED STANDOFF

RELATED APPLICATIONS

This application is a divisional of U.S. patent application Ser. No. 11/464,549 entitled "Cold-Headed Standoff", filed Aug. 15, 2006, now U.S. Pat. No. 7,421,875 which is a continuation of now-abandoned U.S. patent application Ser. No. 10/479,048 entitled "Cold-Headed Standoff," filed Nov. 26, 2003, which was a 371 of PCT/US03/07832 entitled "Cold-Headed Standoff," filed Mar. 18, 2003, priority from which is hereby claimed.

FIELD OF THE INVENTION

The present invention relates to the formation of a self-clinching type metal fastener by a progressive forging process.

BACKGROUND AND DESCRIPTION OF THE PRIOR ART

Internally-threaded, self-clinching type fasteners are well-known in the art. When installed, they provide materials such as sheet metal panels with a threaded structure to receive a screw so that elements can be secured to the panel. A typical self-clinching fastener of the standoff type which includes an elongate barrel is shown in FIGS. 3 and 4. The basic structures of this type of fasteners include a head, a self-clinch groove, a barrel, and an internal bore with threads. The fastener is installed by a press and anvil so that the groove receives the cold flow of metal from the sheet while the polygonal head is embedded into the sheet. These structures secure the fastener to the sheet rigidly, both axially and rotationally.

One effective means for producing a self-clinching fastener of the above-described type is by a progressive die forging process. This process utilizes sequential punch and die forging to create the head, the clinch groove, the barrel, and the internal bore of the fastener from a metal blank or slug. Such a formation process is described for example in U.S. Patent Application Serial No. 2002/0054806 entitled "Grooved Nut and Manufacturing Method Thereof" filed on Jan. 3, 2001 by Sakamura et al. and published on May 9, 2002. This document discloses the progressive punch and die tooling used in this process as exemplified by FIG. 3. As shown in this figure, a horizontally reciprocating ram holds a series of punches, each opposite a respective die providing a series of forging stations. The punches and dies progressively form the basic shape of the fastener from a blank of metal which is moved between stations after each stroke of the ram. The shearing action between the punch and die of the final station trims metal from around the edge of a temporarily formed circular head of the fastener as the blank is pushed through the die by the punch to create the final polygonal shape.

A problem exists with this manufacturing process, however, because the shearing process in the last station of the progressive forging leaves an undesirable upward-facing burr on the top side of the head of the fastener. Furthermore, there is another problem with this final head trimming station in that the scrap ring which results from cutting the material away from the periphery of the circular head to achieve the final polygonal shape often sticks to the face of the trim die, obstructing the continuous operation of the progressive forging process. There is therefore a need in the art to utilize a cold forging process to create a self-clinching fastener which does not have these deficiencies.

SUMMARY OF THE INVENTION

The present invention has been devised to cure the above-described problems of the undesirable manufacturing burr on the head of the fastener and to effect the efficient removal of the trimmed scrap ring at the final station of the head trimming station of the forging process. According to one aspect of the invention, the forging apparatus of the prior art is modified in that the punch and die tooling in the head trimming station are reversed in position. That is, the punch is positioned on the die block while the die is located on the reciprocating punch block. This reverses the direction of relative movement between the fastener and the die so that the burr is formed on the underside of the fastener head rather than the top side. This is more desirable since the underside of the head is embedded into the sheet material once the fastener is applied to a sheet. The burr is then not visible and cannot affect the final appearance of the clinched assembly. Because in the new system the barrel of the fastener is necessarily held within a cavity of the trim punch at the last station, an added reciprocating knock-out pin is employed to eject the part from the punch and through the opposite side of the die.

Reversing the relative direction of movement between the die and the fastener during head-trimming also leaves the scrap ring around the outside of the punch at the final station rather than against the face of the die as in the prior art. This is advantageous since the scrap ring then may be quickly and reliably removed from around the trim punch by a stripper sleeve which pushes the scrap ring off the end of the trim punch after the trim process is completed. This avoids the unreliable scrap removal of the prior art. Additionally, this is also advantageous in separating the finished product from the scrap material, whereby also eliminating the need for costly sorting or manual inspection operations to remove the scrap from the finished product.

Steps of the forging process of the invention at the final head-trimming station may be further described as follows. The fastener blank having a tubular barrel and a temporarily formed circular head is placed into a bore of a punch with the barrel of the fastener residing in the bore and an underside of the circular head abutting an end face of the punch. The forging apparatus then moves the die toward the top side of the fastener until a polygonal cutting edge of the die shears metal from around the edges of the circular head of the fastener blank. Movement of the die stops when the cutting edge lies beyond the punch end face and the underside of the head of the fastener. At this point, a knock-out pin which is reciprocal within the bore of the punch forceably ejects the fastener through a passage in the die and beyond an opposite side of the die into a container for completed parts. The forging apparatus then moves the die away from the punch. Once the die is clear of the punch, a stripper sleeve which is reciprocal about the outside surface of the punch moves from a retracted position over the end of the punch and in doing so removes a scrap ring left around the outside of the punch. Since the orientation of the tooling is horizontal, the scrap ring then falls away from the punch by gravity, and may also be assisted by pressurized oil or air to ensure the downward motion of the scrap ring is achieved. The cycle is then completed and the trim station is now ready to receive the next partially formed fastener blank.

The apparatus for performing the inventive head-trimming process comprises a stationary punch having a bore for holding a barrel portion of a fastener blank, an end face for supporting an underside of a head portion of the fastener blank when held in the bore, and a polygonal shank. The invention further includes a reciprocal die having an internal passage and a trim plate including an aperture, the trim plate aperture having a circumferential polygonal edge closely corresponding to dimensions of the shank of the punch for receiving the punch. The die is movable from a retracted position toward a top side of the fastener blank to an extended trim position where the cutting edge lies beyond the punch end face. There is a knock-out pin reciprocal within the punch bore for ejecting the fastener blank from the bore and through the die passage to an opposite side of the die. A stripper sleeve slidably mounted to the outside surface of the punch is reciprocal between retracted and extended positions by a spring-activated mechanism, the extended position placing a distal end of the sleeve even with the punch end face for removing a scrap ring from the punch. Since the die is movable in a substantially horizontal plane, the scrap ring falls away from the end face of the punch by the force of gravity and can be assisted by pressurized oil and or air as needed. Other objects and advantages of the present invention will be readily apparent to those of skill in the art from the following drawings and description of the preferred embodiments.

BRIEF DESCRIPTION OF THE DRAWINGS

FIG. 1 is a top diagrammatic view of a prior art multi-station cold forging apparatus.

FIG. 2 is a top plan view diagrammatically showing the cold forging apparatus of the present invention.

FIGS. 6A through 6D are side elevation partial cut-away views of the cold forging apparatus of the present invention showing its sequential operation.

DESCRIPTION OF THE PREFERRED EMBODIMENT

Figure 3:
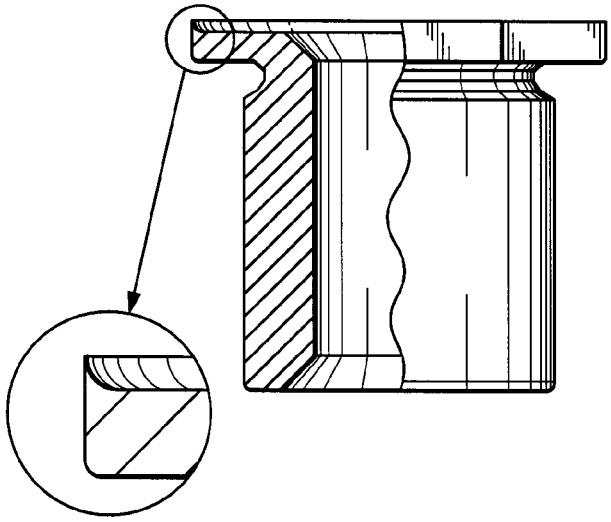
FIG. 3 is a side partial cross section view of a fastener formed by the prior art method.

FIG. 1 diagrammatically depicts the cold forging apparatus of the prior art which includes reciprocating punch block 11 that holds a series of punches 8 that strokes toward and away from die block 13 that holds a series of dies 9 to perform a sequential forging of a metal slug 15 into the general shape of a standard type self-clinching fastener as shown in FIG. 3. This prior art apparatus and the apparatus of the present invention both utilize six forging stations, S1 through S6, beginning with a first station in which metal slug 15 has been severed from a rod-like substrate material 17 and ending with the final sixth station where the cylindrical head is trimmed to a hexagonal shape on a fully formed part. The slug is sequentially moved between stations from one die cavity to the next after each stroke of the punch block by a transfer mechanism well known in the art (not shown). The invention lies within the apparatus and operation of the sixth and final forming station where the circular head of the fastener blank is trimmed to a hexagonal shape.

Referring now to FIG. 2, the fifth and sixth stations of the present invention are depicted, stations 1-5 being essentially the same as shown in the prior art device of FIG. 1. One of the aspects of the invention is the reversal of punch 8 and die 9 elements of the previous stations so that the die assembly 12 of the invention at the sixth station is held by the reciprocating punch block 11 while the punch assembly 14 is fixed in the stationary die block 13. By reversing the position of these elements, the direction of the head trimming shear is reversed. Also, as will be further described, the finished part is ejected through the punch block rather than falling through the stationary die block 13 as in the prior art.

Figure 4:
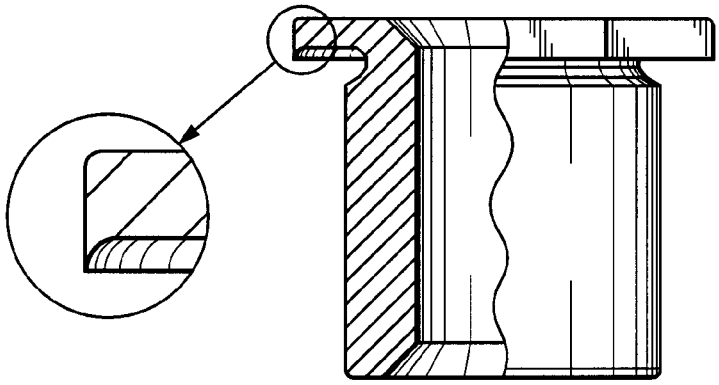
FIG. 4 is a partial cross section view with an enlarged area of a fastener produced by the present invention.

Changing the direction of trim operation has the beneficial effect on the surface characteristics of the fastener head as depicted by FIGS. 3 and 4. As shown in FIG. 3, the prior art method of cold forging shown in FIG. 1 results in an upward-facing trim burr which protrudes from the head of the fastener. This burr is a rough and sharp edge which is aesthetically undesirable. Using the apparatus of the present invention however the burr, which inevitably results from the die shearing method of trimming the head to its final hexagonal shape, now resides along the underside surface of the head of the fastener. Since after installation the head of the fastener is embedded in a substrate material, the trim burr is not visible and the top surface of the head of the fastener is flush with the outside surface of the substrate exhibiting an aesthetically acceptable final appearance after assembly.

Figure 5:
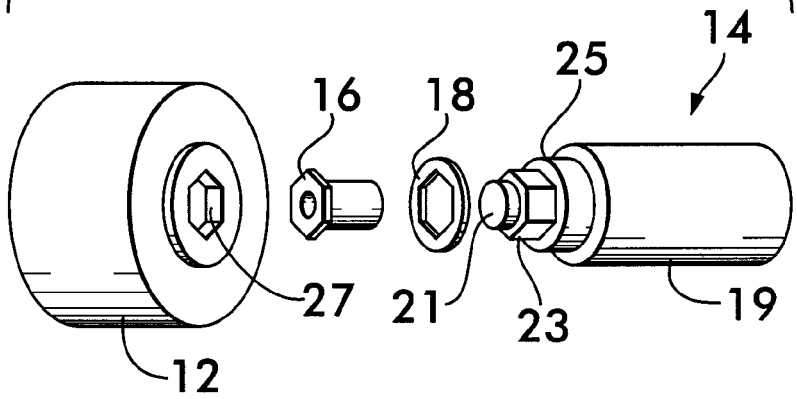
FIG. 5 is an exploded isometric assembly view of the various elements of the present invention corresponding to forging station number six shown in FIG. 2.

Referring now to FIG. 5, the various elements of the invention at the sixth station shown in FIG. 2 are depicted further including the resulting finished part 16 and the trim scrap ring 18. Trim die 12 includes trim plate 27 that has a hexagonal opening with a cutting edge along its inside surface. Punch assembly 14 includes a holder 19 that rigidly secures hexagonal punch 23. The punch assembly further includes a stripper sleeve 25 and a knock-out pin 21 that are slidable within the assembly relative to the fixed punch 23 and holder 19. Means to effect the motion of the stripper sleeve and the knock-out pin are not shown and are well within the knowledge of one of skill in the art.

Referring now to FIGS. 6A through 6D, the four stages of the trim process using the apparatus depicted in FIG. 5 are shown in sequence. Referring first to FIG. 6A, the fastener blank 16 is delivered by a transfer mechanism (not shown) so that a barrel of the fastener resides within the cylindrical bore of a hexagonal punch 23 which is rigidly secured within holder 19. The first step in the trim process begins with the motion of the die 12 toward the fastener. In this position, the underside of the circular head 15 of the fastener blank abuts an end face of the punch.

Referring now to FIG. 6B, the die has moved to the end of its stroke to the completed trim position. A cutting edge on the trim plate 27 on the face of the die has severed a scrap ring 18 from the fastener blank which is sheared by the punch 23 from the circular head of the fastener to provide a resulting hexagonal shape. The hexagonal head now resides within a passage of the die beyond a backside of the trim plate.

The next step of the operation of the invention is shown in FIG. 6C. The knock-out pin 21 which is preferably spring-loaded (spring mechanism not shown) is released and forceably ejects the finished fastener 16 through the die passage 20 and away from an opposite side of the die falling away by the force of gravity as depicted by the arrows shown in this figure. It should be noted at this stage that the scrap ring 18 remains around the outside of the punch 23.

The final stage of the operation of this station is shown in FIG. 6D in which several events occur simultaneously. While the die 12 is being withdrawn to its home position, the knock-out pin 21 is retracted and stripper sleeve 25 is extended to a point flush with the end face of the punch, forcing the scrap ring 18 off of the end of the punch and away from the apparatus by gravity as shown by the arrows. Thereafter, the stripper sleeve 25 is retracted to its home position flush with the endface of holder 19. Now the elements of the punch assembly are in the same position shown in FIG. 6A ready to accept the next fastener from the transfer mechanism and the cycle is thus complete.

It should be understood that there may be other modifications and changes to the present invention that will be obvious to those of skill in the art from the foregoing description, however, the present invention should be limited only by the following claims and their legal equivalents.

The invention claimed is:

1. The method of head trimming a fastener workpiece in a cold-forging apparatus comprising:

placing a fastener workpiece into a bore of a stationary punch at a final processing station of a cold-forging apparatus, said punch having an end face;

retainably holding a barrel portion of the fastener in the bore;

supporting an underside of a head of said fastener workpiece against said punch end face;

moving a die having an internal passage and a trim plate with an aperture having a circumferential polygonal cutting edge closely corresponding to the outside dimension of a shank of said punch toward said fastener workpiece, said trim plate aperture being moveable coaxially relative to said punch from a retracted position toward a top side of said fastener workpiece to an extended trim position; and passing said punch and said fastener head through said trim plate aperture to the extended trim position where said cutting edge lies beyond an underside of the head of the fastener workpiece, thereby trimming excess material from said head.

2. The method of claim 1 further including the step of ejecting said fastener workpiece from said punch bore and through said die passage to an opposite side of said die by reciprocating a knock-out pin within said punch bore.

3. The method of claim 2 further including the step of moving a stripper sleeve slidably mounted on a shank of said punch toward said punch end face until said scrap ring is pushed off of the punch by said sleeve thereby dispensing the scrap ring away from an operating zone between the punch end face and the die.

4. The method of claim 3 wherein said die is moveable in a substantially horizontal plane whereby said scrap ring falls away from the punch by the force of gravity.

5. A fastener head-trimming device utilized in a cold-forging apparatus, comprising:

a stationary punch having a bore retainably holding a barrel portion of a fastener workpiece having a head;

a polygonal shank of said punch having an end face supporting an underside of the head of said fastener workpiece held in said bore;

a die having an internal passage and a trim plate including an aperture, said trim plate aperture having a circumferential polygonal cutting edge closely corresponding to the outside dimension of the shank of said punch for receiving said punch and trimming excess material from said head of said workpiece;

means for moving said die trim plate relative to said punch from a retracted position toward a top side of said fastener to an extended trim position where said cutting edge lies beyond the punch end face; and a knock-out pin reciprocal within said punch bore for ejecting said fastener workpiece from said bore and through said die passage to an opposite side of said die.

6. The device of claim 5 further including a stripper sleeve slidably mounted to the shank of said punch, said sleeve being movable between retracted and extended positions, said extended position placing a distal end of said sleeve beyond said punch end face for removing a workpiece scrap ring from around said punch and dispensing it from an operating zone between the punch and the die and away from the die.

7. The device of claim 5 wherein said die is movable in a substantially horizontal plane and said scrap ring falls away from the end face of said punch by the force of gravity.

8. The device of claim 7 including means for retracting said knock-out pin into said punch bore, thereby creating a cavity in the end of said punch for retainably holding the barrel of said fastener workpiece therein.

9. A cold-forging apparatus, comprising:

a reciprocal punch block holding a series of punches which strokes toward and away from a stationary die block holding a plurality of dies, each defining one of a series of sequential forging stations;

a punch assembly secured to said dieblock at a final forging station comprising a stationary punch having a bore adapted for retainably holding a barrel portion of the fastener workpiece and further including a polygonal shank having an end face adapted for supporting an underside of a head portion of said fastener workpiece for trimming;

a die affixed to said punch block at said final forging station, said die having an internal passage and a trim plate including an aperture, said trim plate aperture having a circumferential polygonal cutting edge closely corresponding to dimensions of the shank of said punch for receiving said punch and trimming excess material from said head of said workpiece; and Wherein said die trim plate is moved relative to said punch from a retracted position toward a top side of said fastener to an extended trim position where said cutting edge lies beyond the punch end face.

10. The apparatus of claim 9 further including a knock-out pin reciprocal within said punch bore for ejecting said fastener workpiece from said bore and through said die passage to an opposite side of said die.

11. The apparatus of claim 10 further including a stripper sleeve slidably mounted on the shank of said punch, said sleeve being movable between retracted and extended positions, said extended position placing a distal end of said sleeve beyond said punch end face for removing a workpiece scrap ring from around said punch and dispensing it from an operating zone between the punch and the die and away from the apparatus.

12. The apparatus of claim 11 wherein said die is movable in a substantially horizontal plane such that upon removal from said punch said scrap ring falls away from the punch by the force of gravity.

* * * * *